US010541484B2

(12) United States Patent
Hsu et al.

(10) Patent No.: US 10,541,484 B2
(45) Date of Patent: Jan. 21, 2020

(54) CONNECTOR ASSEMBLY WITH RETRACTABLE PROBE CONTACT RECESSED BEHIND MATING SURFACE AND STATIONARY PAD CONTACT EXTENDING BEYOND MATING SURFACE

(71) Applicants: FU DING PRECISION INDUSTRIAL (ZHENGZHOU) CO., LTD., Zhengzhou (CN); FOXCONN INTERCONNECT TECHNOLOGY LIMITED, Grand Cayman (KY)

(72) Inventors: Shuo-Hsiu Hsu, New Taipei (TW); Nan-Hung Lin, New Taipei (TW); Ming-Lun Szu, New Taipei (TW)

(73) Assignees: FU DING PRECISION INDUSTRIAL (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/236,356

(22) Filed: Dec. 29, 2018

(65) Prior Publication Data

US 2019/0207335 A1 Jul. 4, 2019

(30) Foreign Application Priority Data

Dec. 29, 2017 (CN) ..... 2017 1 1475767

(51) Int. Cl.

| | |
|---|---|
| ***H01R 12/71*** | (2011.01) |
| ***H01R 13/62*** | (2006.01) |
| ***H01R 13/24*** | (2006.01) |

(52) U.S. Cl.
CPC ..... *H01R 12/716* (2013.01); *H01R 13/2471* (2013.01); *H01R 13/6205* (2013.01); *H01R 13/2407* (2013.01)

(58) Field of Classification Search
CPC ..... H01R 11/30; H01R 13/6205
(Continued)

(56) References Cited

U.S. PATENT DOCUMENTS 7,311,526 B2 * 12/2007 Rohrbach ..... H01R 13/6205 439/39
9,419,377 B2 * 8/2016 Zhu ..... H01R 13/24
(Continued)

FOREIGN PATENT DOCUMENTS

TW M408843 U1 8/2011
TW M485437 U 9/2014

*Primary Examiner* — Hien D Vu
(74) *Attorney, Agent, or Firm* — Wei Te Chung; Ming Chieh Chang

(57) ABSTRACT

An electrical connector assembly comprising a first connector and a second connector mated with each other. The first connector includes a first shell forming a first mating surface thereon. A retractable first contact has a first contacting section moveable between an outer position coplanar with the first mating surface and an inner position recessed from the first mating surface. The second connector includes a second shell forming a second mating surface thereon. A stationary second contact has a second contacting section protruding beyond the second mating surface. During mating, the second contacting section abuts against the first contacting section in the mating direction and protrudes beyond the first mating surface to be snugly received within the first connector.

11 Claims, 8 Drawing Sheets

(58) Field of Classification Search
USPC ..... 439/38–40
See application file for complete search history.

(56) References Cited

U.S. PATENT DOCUMENTS

| | | | | |
|---|---|---|---|---|
| 9,837,750 | B2 * | 12/2017 | Wu | H01R 13/46 |
| 2014/0148018 | A1 * | 5/2014 | Kim | H01R 13/24<br>439/39 |
| 2016/0218446 | A1 | 7/2016 | Fujitsu | |

* cited by examiner

CONNECTOR ASSEMBLY WITH RETRACTABLE PROBE CONTACT RECESSED BEHIND MATING SURFACE AND STATIONARY PAD CONTACT EXTENDING BEYOND MATING SURFACE

BACKGROUND OF THE INVENTION

1. Field of the Invention

The present invention relates generally to an electrical connector assembly, and more particularly to the electrical connector assembly having mated plug connector and receptacle connector by magnetic forces with reliable alignment therebetween.

2. Description of Related Arts

U.S. Pat. No. 9,385,471 discloses the connector assembly having a first connector with a retractable probe contact originally extending beyond the corresponding mating surface and a second connector with a stationary pad contact constantly coplanar with the corresponding mating surface wherein the first connector and the second connector are mated with each other via magnetic forces. Anyhow, the alignment between the first connector and the second connector along the mating direction is essentially made by the peripheral structures of the housing rather than the intimately mated probe contact and pad contact. In addition, the traditional alignment structure formed by the housing of the connector may include corresponding protruding structures and/or the recessed structures, thus jeopardizing the even and smooth configuration on an appearance thereof.

An improved alignment structures for use with the electrical connector assembly is desired.

SUMMARY OF THE INVENTION

An object of the present invention is to provide an electrical connector assembly having corresponding alignment structures around the corresponding contacts rather than on the housing for mating.

To achieve the above-mentioned object, an electrical connector assembly includes a receptacle connector and the plug connector mated with each other. The receptacle connector includes a first shell, a first magnetic section surrounding the first shell, and a first wireless module retained in the first shell. The first shell defines a first mating surface. The first wireless module is hidden behind the first mating surface while the first magnetic section is exposed upon the first mating surface. The plug connector includes a second shell, a second magnetic section surrounding the second shell, and a second wireless module retained in the second shell. The second wireless module is hidden behind the second mating surface while the second magnetic section is exposed upon the second mating surface. The receptacle connector further includes a plurality of retractable probe contacts each having a first contacting section exposed upon the first mating surface. The plug connector further includes a plurality of stationary pad contacts each having a second contacting section exposed and extending beyond the second mating surface. During mating, the first mating surface and the second mating surface intimately confront each other in the mating direction by the corresponding magnetic forces so as to have the second contacting section push the first contacting section backward to form a space behind the first mating surface to receive the second contacting section therein, thus achieving precise alignment between the first mating section and the second mating section and assuring alignment between the first wireless module and the second wireless module in the mating direction for efficient wireless transmission.

DETAILED DESCRIPTION OF THE PREFERRED EMBODIMENT

Figure 1:
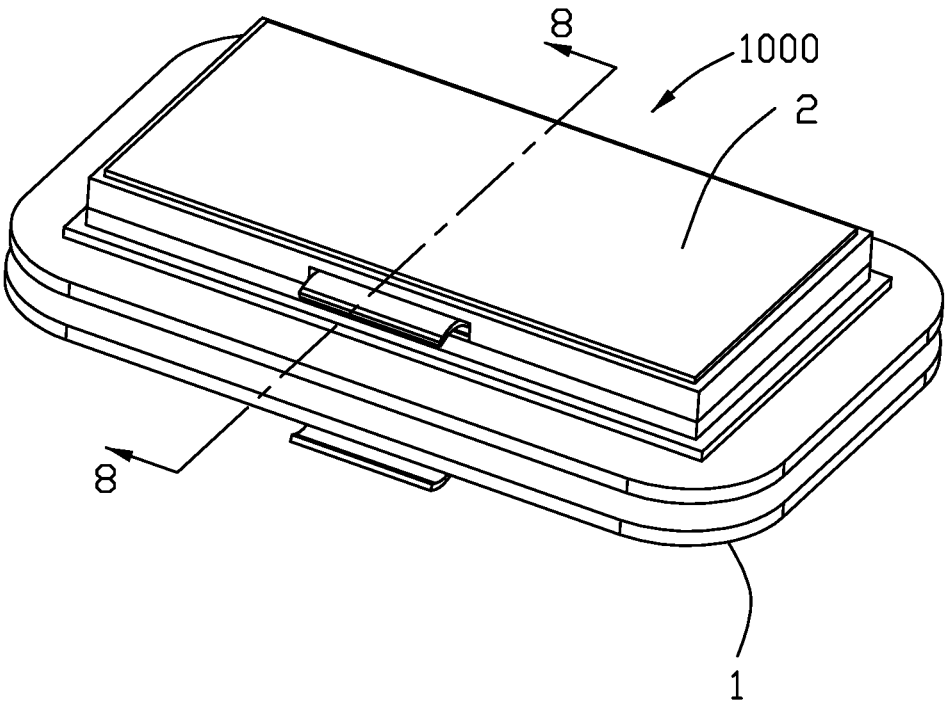
FIG. 1 is a perspective view of an electrical connector assembly according to the present invention.
Figure 2:
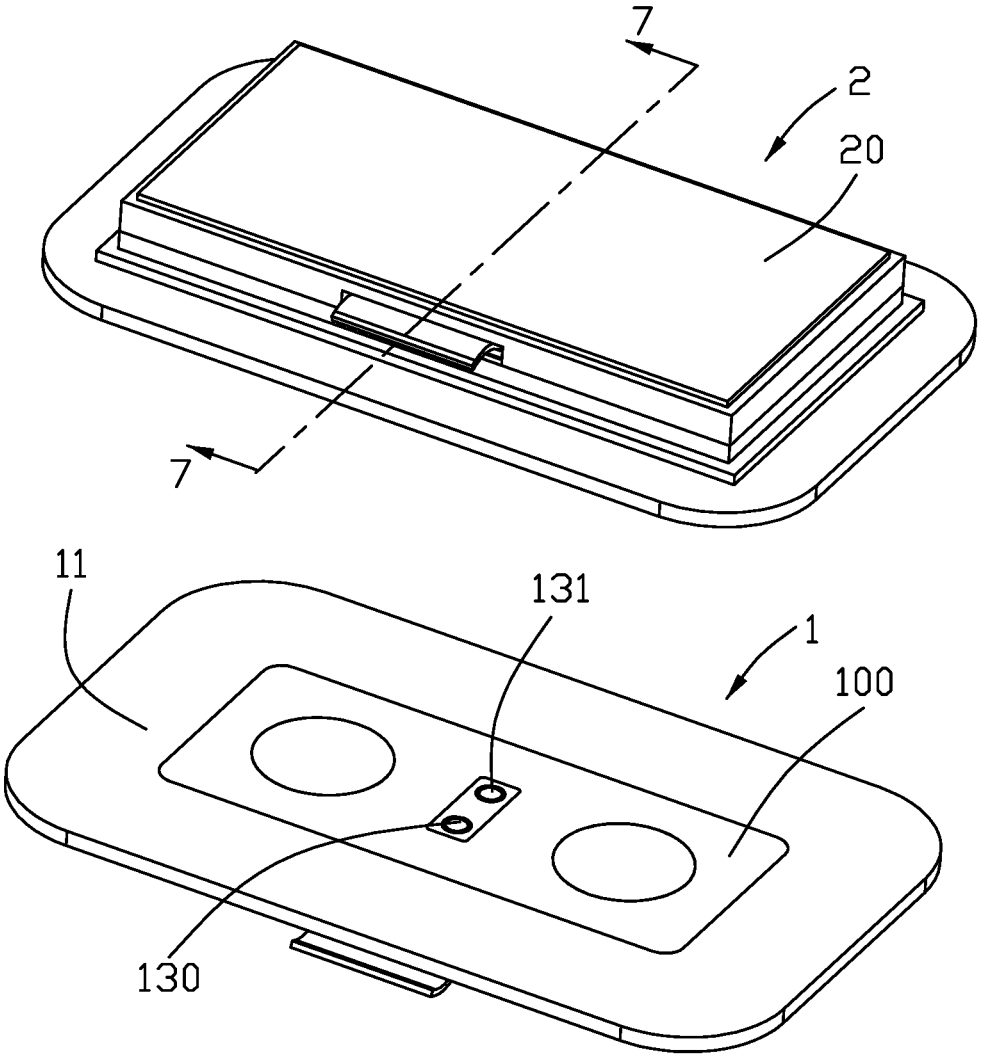
FIG. 2 is a perspective view of the electrical connector assembly of FIG. 1 in an un-mated condition.
Figure 3:
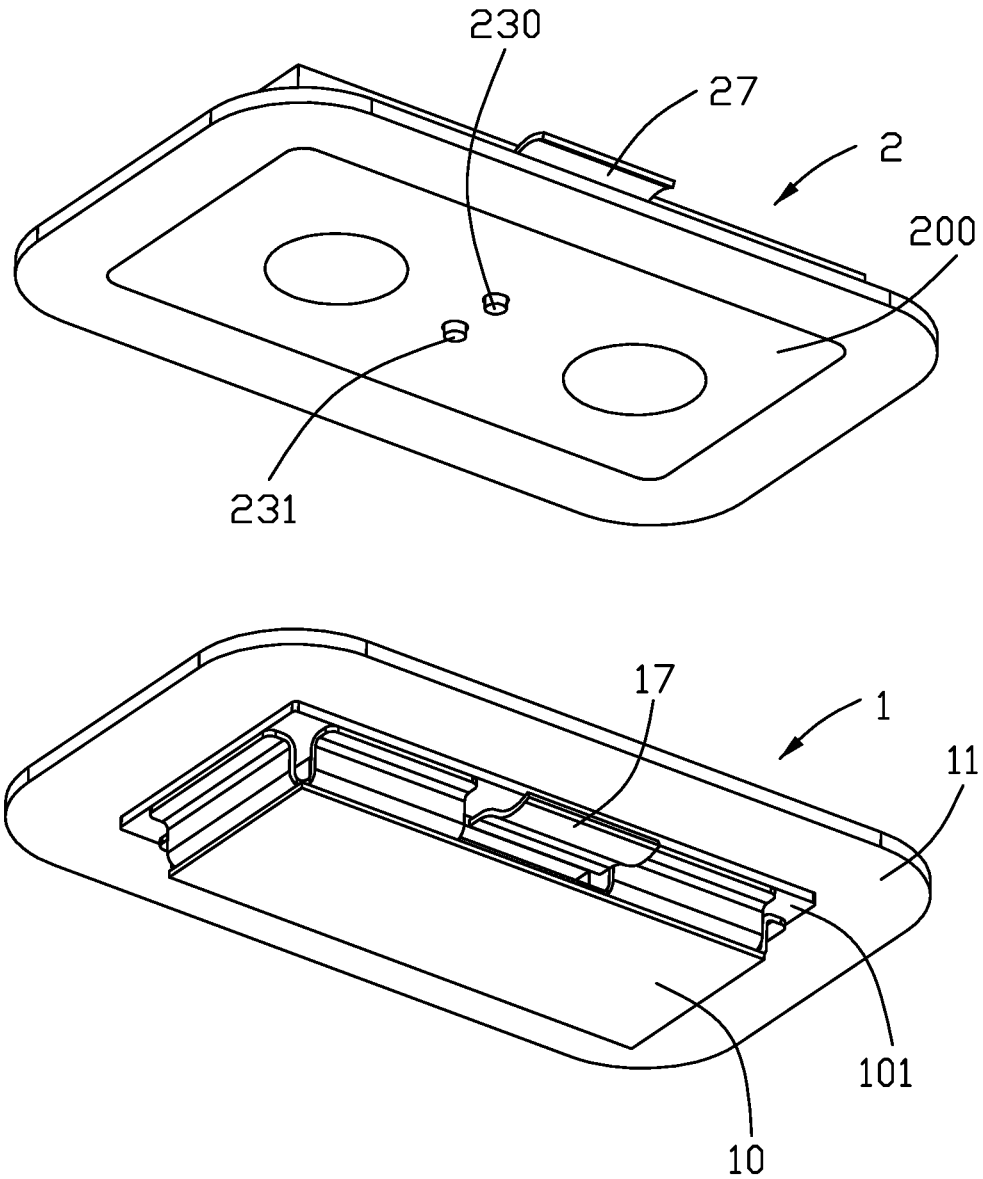
FIG. 3 is another exploded perspective view of the electrical connector assembly of FIG. 2.
Figure 4:
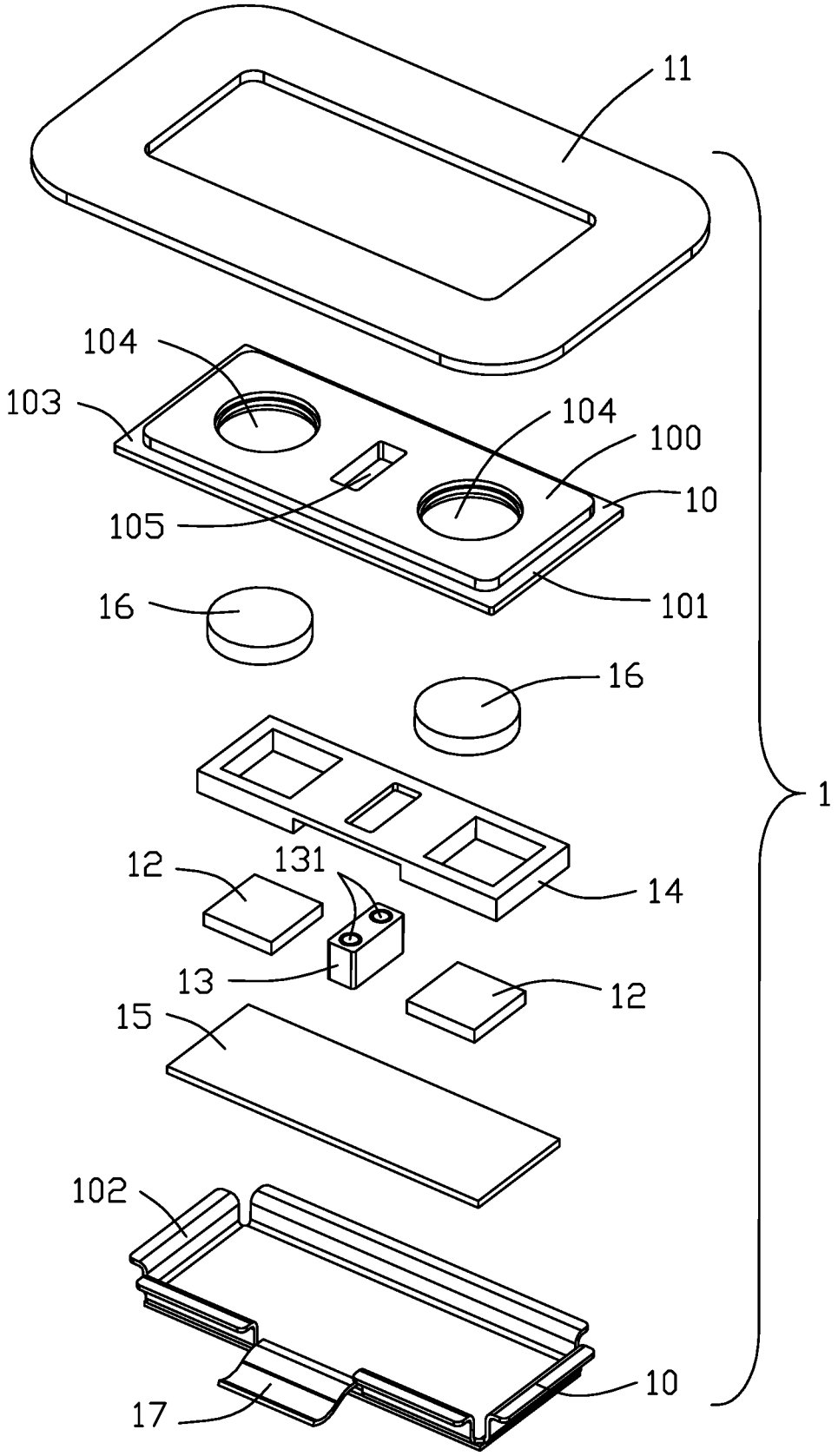
FIG. 4 is an exploded perspective view of the first connector of the electrical connector assembly of FIG. 1.
Figure 5:
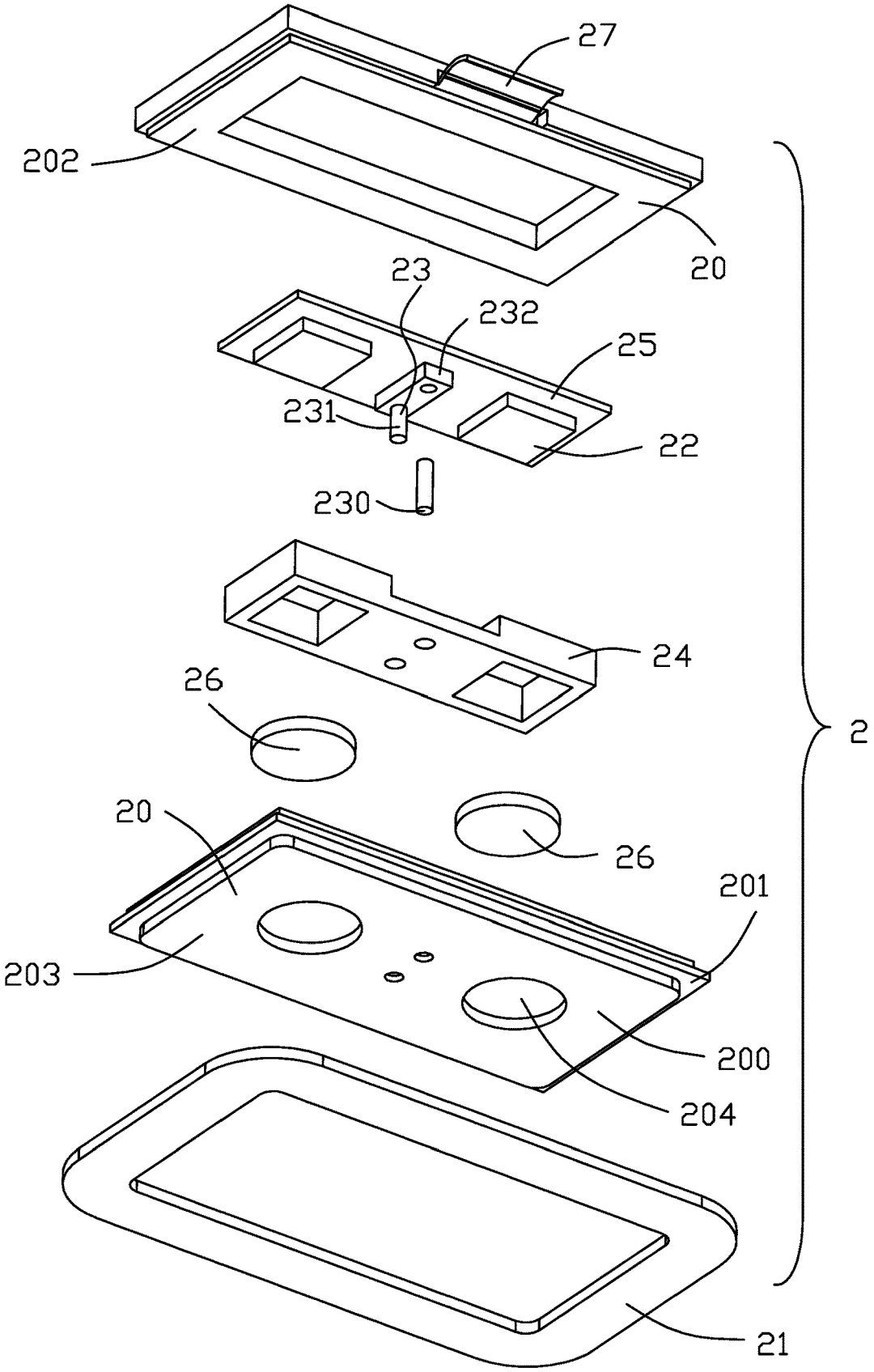
FIG. 5 is an exploded perspective view of the second connector of the electrical connector assembly of FIG. 1.
Figure 6:
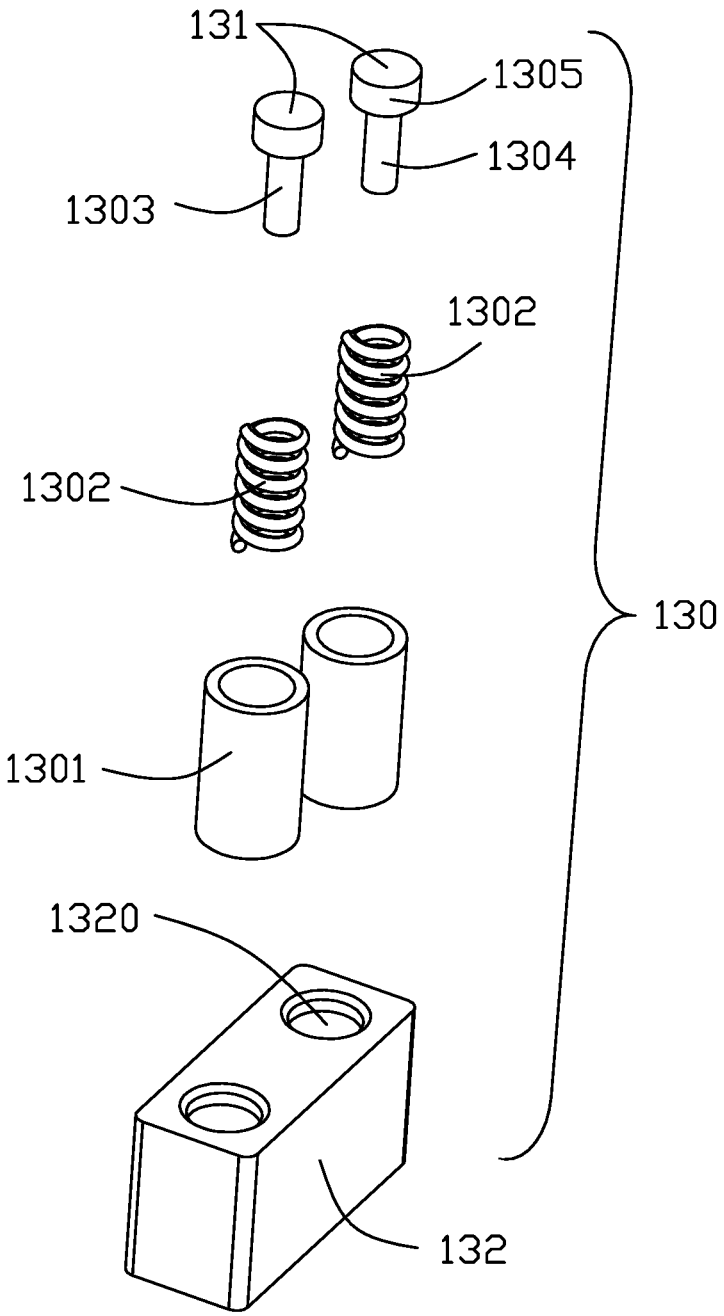
FIG. 6 is another exploded perspective view of the first contact unit of the electrical connector assembly of FIG. 1.
Figure 7:
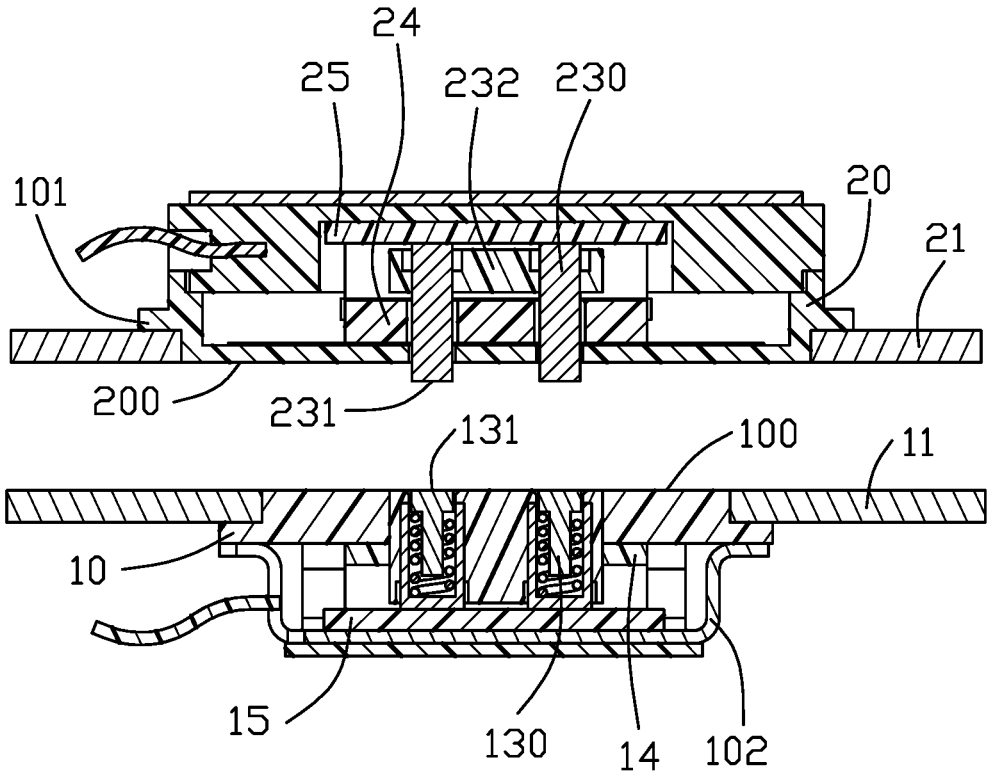
FIG. 7 is a cross-sectional view of the electrical connector assembly of FIG. 1 in an un-mated connector.
Figure 8:
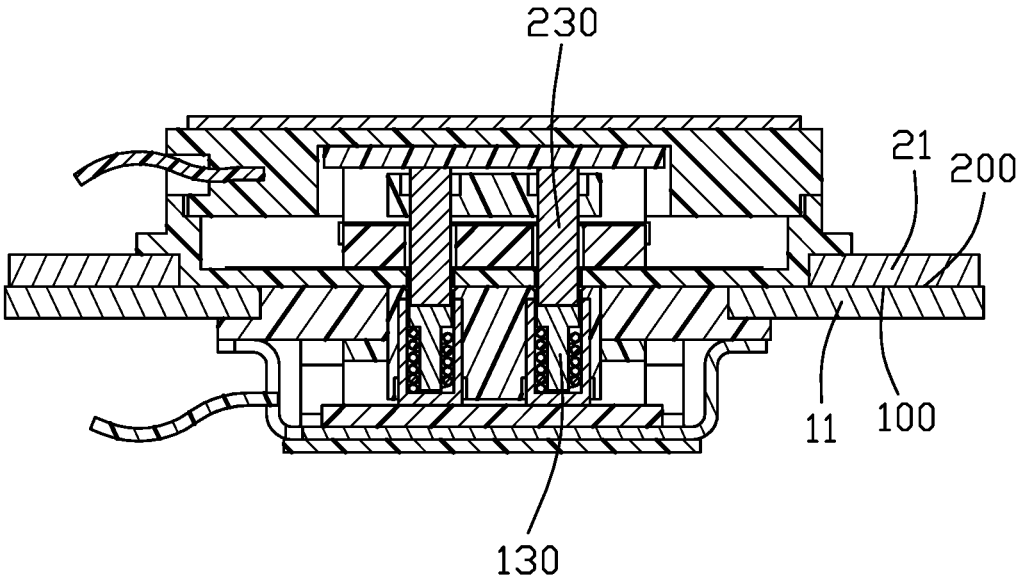
FIG. 8 is a cross-sectional view of the electrical connector assembly of FIG. 1 in a mated condition.

Referring to FIGS. 1 to 8, an electrical connector assembly 1000 includes a first/receptacle connector 1 and a second/plug connector 2 mated with each other. The first connector 1 is used with the portable device (not shown) and the second connector 2 is used with the peripheral (not shown) for achieving communication therebetween.

The first connector 1 includes a first shell 10, the first magnetic section 11 surrounding the first shell, and a pair of first wireless modules 12 retained in the first shell 10. The first shell 10 forms a first mating surface 100 and the first wireless modules 12 are hidden behind the first mating surface 100. The first magnetic section 11 is coplanar with the first mating surface 100. The second connector 2 includes a second shell 20, the second magnetic section 21 surrounding the first shell 20, and a pair of second wireless modules 22. The second shell 20 forms a second mating surface 200 and the second wireless modules 22 are hidden behind the second mating surface 200. The second magnetic section 21 is coplanar with the second mating surface 20. The first connector 1 includes a plurality of first contacts 130 back and forth retractable along the mating direction. The first contact 130 includes a first contacting section 131. The second connector 2 includes a plurality of second contacts 230 in a stationary manner. The second contact 230 includes a second contacting section 231. In this embodiment, at least one of the first magnetic section 11 and the second magnetic section 21 is a magnet and the other is a magnetic attractive member like iron.

During mating between the first connector 1 and the second connector 2, the first mating surface 100 and the second mating surface 200 intimately abut against each other in the mating direction by means of attraction between the first magnetic section 11 and the second magnetic section 21. The second contacting section 231 extends into the first connector 1 to abut against the first contacting section 131. In other words, the first connector 1 forms a recess (not labeled) to snugly receive the second contacting section 231 so as to result in an alignment effect. Therefore, the first connector 1 and the second connector 2 are correctly and precisely aligned with each other as well as the first wireless modules 12 and the second wireless modules 22 in the mating direction.

The first shell 10 includes a first base or flange 101 against which the first mating section 11 abuts in the mating direction. The second shell 2 includes a second base 201 against which the second magnetic section 21 abuts in the mating direction.

The first connector 1 is mounted upon an portable device (not shown) while the second connector is mounted upon an peripheral equipment (not shown). The first mating surface 11 is coplanar with the portable device and the second mating surface 21 is coplanar with the peripheral equipment. The portable device can be the cellular phone and the peripheral equipment can be the camera. In this embodiment, the first contacting section 11 is coplanar with the first mating surface 100 when un-mated, and of the same cover with the first mating surface 100, if optimal.

The connector 1 includes a first printed circuit board 15 retained in the first shell 1, a pair of first covers 16 received within the corresponding holes 104 in the first shell 10, a first seat 14 located between the first printed circuit board 15 and the first base 101, and a first contact unit 13. The first contact unit 13 includes a first insulator 132 and a pair of first contacts 130 disposed therein. The first contact unit 13 and the first wireless modules 12 are retained in the first seat 14 and mechanically and electrically connected to the first printed circuit board 15. Each first wireless module 12 is located behind the corresponding first cover 16.

The first insulator 132 forms a pair of holes 1320 to receive the corresponding first contacts 130. The first contact 130 includes a sleeve 1301, a spring 1302 enclosing a moveable part 1303 which includes a main body 1304 surrounded by the spring 1302, and a head 1305 on which the first contacting section 131 is formed. During mating, the second contacting section 231 of the second contact 230 pushes the first contacting section 131 of the first contact 130 backwardly to compress the spring 1302, and successively is inserted into the hole 1320 in a snug manner so as to achieve precise alignment between the first connector 1 and the second connector 2 in the mating direction.

The second connector 2 has the similar structures with the first connector 1 and includes a second seat 24 and a pair of second wireless modules 23. The second contact unit 23 includes a second insulator 232 and the second contacts 230 therein. The second connector 2 includes the second printed circuit board 25 and the second covers 26. The second contacts 230 and the second wireless modules 22 are mechanically and electrically connected to the second printed circuit board 25. The second shell 2 forms a pair of holes 204 to receive the corresponding second covers 26 behind which the second wireless modules are located.

In this embodiment, the first contacts 130 and the first wireless modules 12 are soldered upon the first printed circuit board 15; similarly the second contacts 230 and the second wireless modules 25 are soldered upon the second printed circuit board 25, In this embodiment, the first shell 10 is a hybrid type includes a front part 103 where the first mating surface 100 is formed and a rear part including a first frame 102. In this embodiment, the front part 103 is plastic while the rear part is metal. Similarly, the second shell 20 includes a front part 203 where the second mating surface 200 is formed, and a rear part including a second frame 202

The first seat 14 forms holes to position the corresponding wireless modules 12 and the first contact unit 13. The first cover 16 guides transmission along the mating direction. The first shell 10 forms the hole 105 to receive the first contact unit 13. The first connector 1 includes a first flexible printed circuit 17 connected to the first printed circuit board 15, and the second connector 2 includes a second flexible printed circuit 27 connected to the second printed circuit board 25 as well.

In brief, during mating the first magnetic section 11 and the second magnetic section 21 are intimately attracted with each other so as to have the first mating surface 100 and the second mating surface 200 also intimated confront each other, thus forcing the second contacting section 231 to enter the corresponding hole 1320 to push the first contacting section 131 backward. Because the second contacting section 231 of the second contact 230 is received within the hole 1320 and further into the sleeve 1301 in a snug manner, the alignment between the first connector 1 and the second connector 2 is assured.

Compared with the conventional design which uses the retractable probe contact movable between the exterior/protruding position and the mating surface position, and the stationary pad contact essentially coplanar with the mating surface with only the power transmission without providing the alignment effect derived from the contacts of the mated connector, the contact arrangement of the invention using the retractable probe contact moveable between the mating surface position and the interior/recessed position and the stationary pad contact essentially protruding significantly beyond the mating surface, provides not only the power transmission function but also the alignment function additionally advantageously.

What is claimed is:

1. An electrical connector assembly comprising:

a first connector including:

a first shell defining a first mating surface;

a first magnetic section essentially coplanar with the first mating surface;

a retractable first contact having a movable first contacting section which has a head positioned coplanar with the first mating surface, and a body positioned rearward from the first mating surface with a distance;

a second connector including:

a second shell defining a second mating surface;

a second magnetic section essentially coplanar with the second mating surface;

a stationary second contact having a second contacting section protruding outward beyond the first mating surface with said distance;

wherein when the first connector and the second connector are mated with each other, the first mating surface and the second mating surface intimately confront each other in a mating direction, and the second contacting section is snugly received within a hole in the first connector behind the first mating surface;

wherein the first connector has a first contact unit having a first insulator to receive said retractable first contact therein;

wherein said first connector further includes a first seat to receive said first contact unit;

wherein said first connector further includes a first wireless module received within the first seat; and wherein said first connector are connected further includes a printed circuit board on which both the first contact unit and the first wireless module are connected.

2. The electrical connector assembly as claimed in claim 1, wherein the retractable first contact has a movable part associated with a spring commonly received within an immovable sleeve.

3. The electrical connector assembly as claimed in claim 2, wherein during mating, the second contacting section enters the sleeve.

4. The electrical connector assembly as claimed in claim 1, wherein the first wireless module is hidden behind the first mating surface.

5. The electrical connector assembly as claimed in claim 1, wherein the first shell includes a front part where the first mating surface is formed, and a rear part being of a frame structure.

6. The electrical connector assembly as claimed in claim 5, wherein the front part is insulative while the rear part is metallic.

7. An electrical connector for mating with a complementary connector, comprising:

a shell forming a mating surface thereon; a magnetic section coplanar with the mating surface;

and a retractable contact having a contacting section moveable between an outer position, which is coplanar with mating surface, and an inner position recessed from the mating surface with a distance;

a wireless module;

wherein both said wireless module and the retractable contact are mounted upon a printed circuit board;

wherein the retractable contact includes a immoveable sleeve mounted upon the printed circuit board, and a moveable part associated with a spring to be commonly received within the sleeve, said contacting section being formed on the movable part;

wherein said sleeve is hidden behind the mating surface; and wherein the shell includes a front part made of plastic and a rear part made of metal.

8. The electrical connector as claimed in claim 7, wherein the contacting section is moveable backward offset from a front edge of the sleeve so as to allow a contacting section of a protruding pad contact of the complementary connector to enter the sleeve.

9. An electrical connector assembly comprising:

a first connector including:

a first shell defining a first mating surface;

a first magnetic section surrounding the first mating surface;

a retractable first contact having a movable first contacting section which has a head positioned coplanar with the first mating surface, and a body positioned rearward from the first mating surface with a distance;

a second connector including:

a second shell defining a second mating surface;

a second magnetic section surrounding the second shell;

a stationary second contact having a second contacting section protruding outward beyond the first mating surface with a second distance;

wherein when the first connector and the second connector are mated with each other, the first mating surface and the second mating surface intimately confront each other in a mating direction, and the second contacting section is snugly received within a recess in a first contact unit of the first connector behind the first mating surface;

wherein said first connector further includes a first seat to receive said first contact unit;

wherein said first connector further includes a first wireless module received within the first seat;

wherein said first connector are connected further includes a printed circuit board on which both the first contact unit and the first wireless module are connected; and wherein the first connector has a first wireless module hidden behind the first mating surface, and the second connector has a second wireless module hidden behind the second mating surface.

10. The electrical connector assembly as claimed in claim 9, wherein the first distance is equal to the second distance.

11. The electrical connector assembly as claimed in claim 10, wherein the first magnetic section is coplanar with the first mating surface, and the second magnetic section is coplanar with the second mating surface.

* * * * *